US008545175B2

(12) United States Patent
Lewis et al.

(10) Patent No.: US 8,545,175 B2
(45) Date of Patent: Oct. 1, 2013

(54) ROTOR BLADE OVER-TIP LEAKAGE CONTROL

(75) Inventors: Leo V Lewis, Kenilworth (GB); Bengt E G Blidmark, Madrid (ES)

(73) Assignee: Rolls-Royce PLC, London (GB)

( * ) Notice: Subject to any disclaimer, the term of this patent is extended or adjusted under 35 U.S.C. 154(b) by 622 days.

(21) Appl. No.: 12/825,493

(22) Filed: Jun. 29, 2010

(65) Prior Publication Data

US 2011/0002771 A1 Jan. 6, 2011

(30) Foreign Application Priority Data

Jul. 3, 2009 (GB) ..... 0911500.7

(51) Int. Cl.
*F01D 5/20* (2006.01)

(52) U.S. Cl.
USPC ..... 415/173.4

(58) Field of Classification Search
USPC ..... 277/409, 416, 417, 418; 415/1, 415/173.1, 173.4, 174.4
See application file for complete search history.

(56) References Cited

U.S. PATENT DOCUMENTS

| | | | | |
|---|---|---|---|---|
| 3,880,550 | A | 4/1975 | Corey et al. | |
| 4,349,313 | A * | 9/1982 | Munroe et al. | 415/173.4 |
| 6,197,424 | B1 * | 3/2001 | Morrison et al. | 428/402 |
| 6,203,273 | B1 * | 3/2001 | Weiner et al. | 415/173.4 |
| 7,178,808 | B2 * | 2/2007 | Grunke et al. | 277/409 |
| 2004/0009365 | A1 * | 1/2004 | Fried et al. | 428/614 |
| 2006/0062664 | A1 | 3/2006 | Campino Johnson | |
| 2008/0124548 | A1 * | 5/2008 | Sporer et al. | 428/402 |
| 2009/0110560 | A1 * | 4/2009 | Bayer et al. | 416/241 R |

FOREIGN PATENT DOCUMENTS

| | | |
|---|---|---|
| EP | 1 382 799 A2 | 1/2004 |
| GB | 2 121 884 A | 1/1984 |
| GB | 2 125 119 A | 2/1984 |
| GB | 2 399 777 A | 9/2004 |

OTHER PUBLICATIONS

Search Report issued in corresponding British Patent Application No. 0911500.7, completed Oct. 9, 2009.

* cited by examiner

*Primary Examiner* — Edward Look
*Assistant Examiner* — Liam McDowell
(74) *Attorney, Agent, or Firm* — Oliff & Berridge, PLC

(57) ABSTRACT

Some embodiments control rotor blade over-tip leakage of a working fluid in a rotating machine, which includes a circumferential row of rotor blades. A circumferential row of seal segments seal with the radially outer tips of the rotor blades to reduce over-tip leakage of the working fluid. The seal segments have an inboard abradable layer adapted to be abraded by the blade tips to form a wear track for the blade tips. Tip wearing bodies are adapted to wear down the blade tips. The abradable layer thickness and cold build radial positions of the blade tips, seal segments, and tip wearing bodies are arranged such that, during running-in of the machine, a wear track having a uniform radius is formed in the abradable layer by the blade tips, and the tip wearing bodies wear down the blade tips to provide a uniform blade tip radius.

15 Claims, 2 Drawing Sheets

ROTOR BLADE OVER-TIP LEAKAGE CONTROL

BACKGROUND

The present invention relates to a system and method for controlling rotor blade over-tip leakage of a working fluid in a rotating machine.

The working fluid of a gas turbine engine is operated on by circumferential rows of turbine and compressor blades which rotate within static casings. To achieve high efficiencies it is important that over-tip leakage by the working fluid (i.e. leakage between a blade and a casing) is minimised by letting the rotating blades run as close as possible to the casings.

Blades can be shroudless or can have shrouds with radially outer sealing fins, but both have the same problem of over-tip leakage.

Considering a row of conventional shrouded turbine blades with seal fins, the part of the corresponding casing closest to the fin tips is typically formed by a circumferential row of seal segments which are hooked into the casing. Each seal segment has a layer of abradable material facing inboard to the fins. The fin tips are normally designed to rub into the abradable material to form a wear track that provides a seal against over-tip leakage. To accommodate differential thermal expansion effects and inevitable variation in radial position of the individual segments, the abradable material has a thickness well larger than the predicted maximum incursion. The fin tips are often coated with a resistant material so that when they come in contact with the abradable material, the abradable material is rubbed away preferentially to the tips.

However, due to build and assembly tolerances, there can be variation in the radial positioning of the seal segments and in the radial positioning of the blade tips. Also, each segment has a tendency to flatten during engine operation due to the temperature difference across the segment, resulting in a slightly higher hot running radius at the ends of each segment than in the centre. In addition, the casing into which the segments hook may not be perfectly circular.

For an optimal (i.e. minimised) clearance, circumferentially continuous rubs are required as this ensures that the radial differences of the segments are eliminated. However, the deepest rub is created by the longest blade as it sweeps around, resulting in a performance deficit proportional to the averaged gap due to the variation in fin tip length.

By using a suitable thickness of abradable material and choosing a tight build clearance, some of the difficulties associated with variation in the radial positioning of the seal segments, segment flattening, and casing non-circularity can be addressed (although it is not unusual to see engines without all-round rubs or rubs only at the centre of the seal segments). However, conventional sealing systems struggle to address also variation in blade tip radial positioning.

In general terms, the present invention provides a system and method for controlling rotor blade over-tip leakage of a working fluid in a rotating machine in which not only is an abradable layer abraded by the blade tips to form a wear track for the tips having a uniform radius, but also means are provided to wear down the blade tips to provide a uniform blade tip radius.

By forming the wear track with a uniform radius to match the uniform blade tip radius, an optimal, or close to optimal, clearance can be produced at each tip to reduce over-tip leakage and improve operating efficiencies.

BRIEF SUMMARY

Thus a first aspect of the invention provides a system for controlling rotor blade over-tip leakage of a working fluid in a rotating machine, the system having:

a circumferential row of rotor blades, a circumferential row of seal segments for sealing with the radially outer tips of the rotor blades to reduce over-tip leakage of the working fluid, the seal segments having an inboard abradable layer which is adapted to be abraded by the blade tips to form a wear track for the blade tips, and one or more tip wearing bodies which are adapted to wear down the blade tips;

wherein the thickness of the abradable layer and the cold build radial positions of the blade tips, seal segments and tip wearing bodies are arranged such that, during running-in of the machine, a wear track having a uniform radius is formed in the abradable layer by the blade tips, the tip wearing bodies also wearing down the blade tips to provide a uniform blade tip radius.

The system may have any or any combination of the following optional features.

Typically the wear track is substantially circumferentially continuous.

Typically, at least the blade tip contacting portion of the or each tip wearing body is more wear resistant than the blade tips (generally the contacting portion has a hardness value which is higher than that of the blade tips) in order that the tips are worn down in preference to the tip wearing body. The or each tip wearing body can be formed of a wear resistant material, or can merely have a coating of such a material at the blade tip contacting portion.

Conveniently, the or each tip wearing body may be a portion of a respective seal segment, the abradable layer being formed on the body.

However, it is possible also for the system to have one or more separate tip wearing bodies, e.g. interposed between adjacent seal segments. In this case, the circumferential width of the or each body is preferably relatively small in order that a substantially circumferentially continuous blade tip wear track can be formed.

The system may have only one tip wearing body, or may have a plurality of the bodies, e.g. each seal segment incorporating a respective body.

Preferably, the thickness of the abradable layer is equal to or greater than the maximum variation in seal segment radial position. This can help to ensure that the wear track is substantially circumferentially continuous.

Preferably, the cold build radial positions are arranged such that the tip of the shortest blade touches the most radially inward or only tip wearing body at the maximum closure of the blade tips towards the seal segments during running-in. This can help to ensure that the tip of even the shortest blade is worn down.

Preferably, the cold build radial positions are arranged such that the tip of the longest blade does not touch the most inboard seal segment. This can help to ensure that the blades freely rotate at machine start up.

The blade tips may be the radially outward tips of shroudless or of shrouded blades.

Preferably the rotating machine is a gas turbine engine.

Indeed, a further aspect of the invention provides a rotating machine, such as a gas turbine engine, having one or more systems of according to the first aspect of the invention, the or each system optionally including any one or any combination of the optional features of the first aspect.

A further aspect of the invention provides a method of controlling rotor blade over-tip leakage of a working fluid in a rotating machine, the method including:

providing (i) a circumferential row of rotor blades, (ii) a circumferential row of seal segments for sealing with the radially outer tips of the rotor blades to reduce over-tip leakage of the working fluid, the seal segments having an inboard abradable layer which is adapted to be abraded by the blade tips to form a wear track for the blade tips, and (iii) one or more tip wearing bodies which are adapted to wear down the blade tips; and running-in the machine such that a wear track having a uniform radius is formed in the abradable layer by the blade tips, and the tip wearing bodies also wear down the blade tips to provide a uniform blade tip radius.

Thus the method corresponds to the system of the first aspect. The method may have any or any combination of the following optional features.

Typically the wear track is substantially circumferentially continuous.

Typically, at least the blade tip contacting portion of the or each tip wearing body is more wear resistant than the blade tips (generally the contacting portion has a hardness value which is higher than that of the blade tips) in order that the tips are worn down in preference to the tip wearing body. The or each tip wearing body can be formed of a wear resistant material, or can merely have a coating of such a material at the blade tip contacting portion.

Conveniently, the or each tip wearing body may be a portion of a respective seal segment, the abradable layer being formed on the body.

However, it is possible also for the system to have one or more separate tip wearing bodies, e.g. interposed between adjacent seal segments. In this case, the circumferential width of the or each body is preferably relatively small in order that a substantially circumferentially continuous blade tip wear track can be formed.

Only one tip wearing body may be provided. Alternatively, a plurality of the bodies may be provided, e.g. each seal segment incorporating a respective body.

Preferably, the thickness of the abradable layer is equal to or greater than the maximum variation in seal segment radial position.

Preferably, the method further includes a step before the running-in step of arranging the cold build radial positions of the blade tips, seal segments and tip wearing bodies such that the tip of the shortest blade touches the most radially inward or only tip wearing body at the maximum closure of the blade tips towards the seal segments during running-in.

The blade tips may be the radially outward tips of shroudless or shrouded blades.

Preferably, the method further includes a step before the running-in step of arranging the cold build radial positions of the blade tips, seal segments and tip wearing bodies such that the tip of the longest blade does not touch the most inboard seal segment.

Preferably the rotating machine is a gas turbine engine.

Embodiments of the invention will now be described by way of example with reference to the accompanying drawings in which:

DETAILED DESCRIPTION

The present invention makes use of variations in material hardness (or rather resistance to wear) to achieve a uniform radius of the seal segment as well as of the blade tips once an engine has been run-in. This can be achieved by providing seal segments, each having a layer of abradable material inboard of a harder, tip wearing, part of the segment, and letting the blade tips run through the abradable material to be turned against the harder part.

Figure 1:
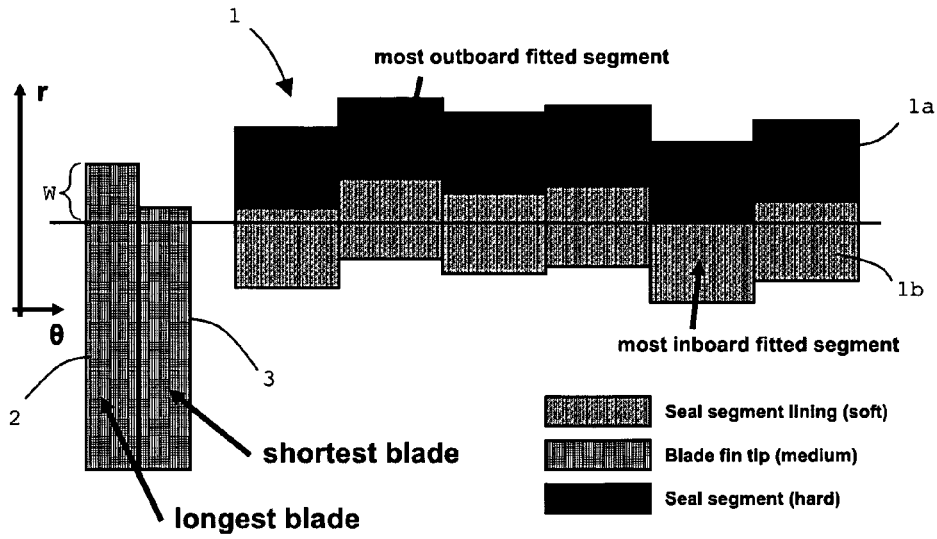
FIG. 1 shows schematically a row of seal segments (for convenience shown aligned linearly) and two blades (for convenience shown positioned to one side of the row of seal segments) in an embodiment of the invention, the seal segments and the blades being shown in positions of maximum closure during running-in but in a condition as if no wear of segments or blades had taken place.

FIG. 1 shows schematically a row of seal segments 1 (for convenience shown aligned linearly, rather than circumferentially) and first 2 and second 3 blades (for convenience shown positioned to one side of the row of seal segments) in a first embodiment of the invention. The first blade represents the longest blade of a row of blades, and the second blade represents the shortest blade of the row. The seal segments and the blades are shown in positions of maximum closure during running-in but in a condition as if no wear of segments or blades had taken place.

Each seal segment has a relatively hard material body part 1*a* (or alternatively be coated with a hard material). Inboard of the body part, a layer 1*b* of abradable, relatively soft material is formed. The thickness of the abradable layer depends on the expected variation in seal segment radius (as explained below). The tips of the blades are formed of a material having an intermediate hardness to that of the body part and the abradable layer.

During the running-in of the engine, the blades 2, 3 move radially towards the segments 1. The longest blade 2 starts to rub the abradable layer 1*b*. It continues to rub until it reaches the hard (tip wearing) body part 1*a* of the most inward fitted segment (indicated in FIG. 1). Any one of the segments can be the most inward fitted segment.

When in contact with the hard body part 1*a* of that segment, the tip of blade 2 starts to wear. As the incursion continues, the tips of the shorter blades are also turned on the hard body part of the most inward fitted segment. The radial extent of the tips will be reduced until maximum incursion has been reached. By a suitable choice of cold build setting and thickness of the abradable layer 1*b*, it is possible to ensure that even the shortest blade 3 will be turned against the most inward fitted segment. Due to the flattening of the segments during engine operation, it is possible that only the centre of the more inward fitted segments act to wear the tips of the shorter blade. However this can help to reduce a risk that the tips might run into the edges of the seal segments.

Figure 2:
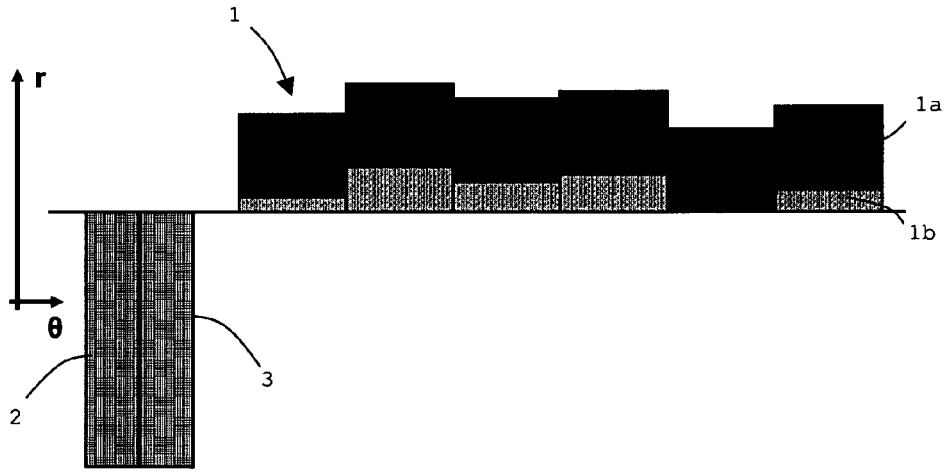
FIG. 2 shows schematically the same row of seal segments and blades as shown in FIG. 1, but after completion of engine running-in with the segments and blades fully worn.

When the tips move away from segment after the running-in procedure, a uniform radius of the wear track formed by the tips in the seal segments, as well as a uniform radius of the blade tips results, as illustrated in FIG. 2, which shows the same row of seal segments and blades as FIG. 1, but after the engine running-in is complete with the segments and blades fully worn. The wear track is also circumferentially continuous. These uniform radii can provide an optimal, or close to optimal, clearance for the blade tips for the reduction of over-tip leakage. Segment flattening and variation in segment and blade radial positioning do not prevent the uniform radii being achieved.

Figure 3:
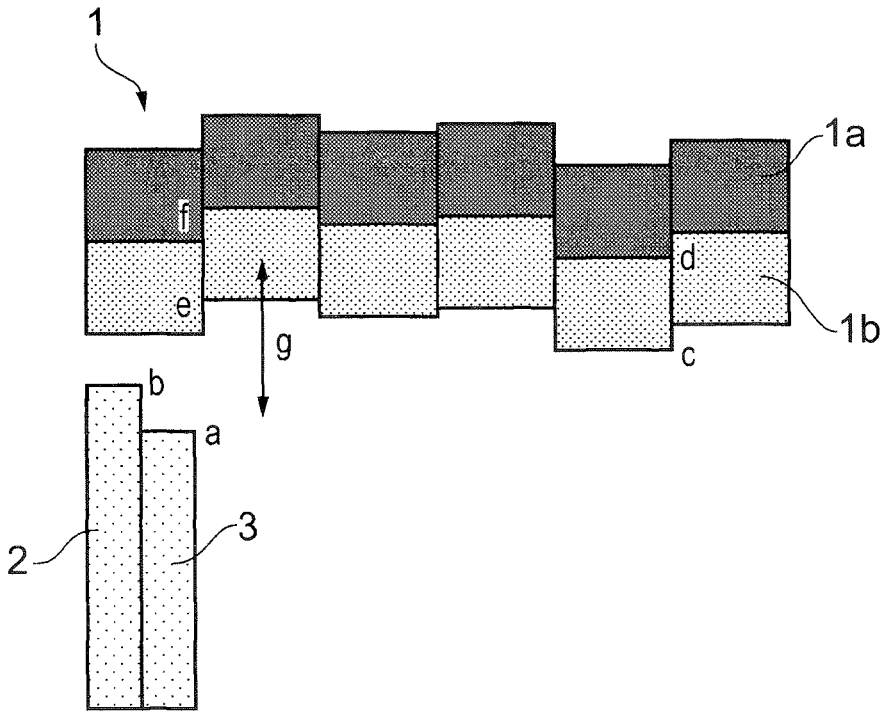
FIG. 3 shows schematically the same row of seal segments and blades as shown in FIG. 1, but with the blades in their cold build (and pre-worn) condition and no longer positioned to one side.

To achieve this result, consideration is given to cold build clearances and the abradable layer 1*b* thickness. FIG. 3 shows schematically the same row of seal segments and blades as FIG. 1, but with the blades 2, 3 in their cold build (and pre-worn) condition and no longer positioned to one side. Selected radial positions are indicated by the following letters:

a=tip of shortest blade
b=tip of longest blade
c=abradable layer surface of most inboard seal segment
d=abradable layer/body part interface of most inboard seal segment
e=abradable layer surface of most outboard seal segment
f=abradable layer/body part interface of most outboard seal segment
g=maximum closure of blade tips towards seal segments during running-in (i.e. peak rubbing closure)

To achieve uniform radii of the wear track and blade tips, preferably three conditions are met:

1. The tip of the shortest blade touches the hard body part of the most inboard seal segment at peak rubbing, i.e.:

$$a+g>d \tag{1}$$

This ensures that even the shortest blade is worn down.

2. The tip of the longest blade does not touch the most inboard seal segment at cold build, i.e.:

$$b<c \tag{2}$$

This is to allow the blades to freely rotate and avoid damage at engine start up.

3. The thickness of the abradable layer is at least the expected maximum variation in seal segment radial position, i.e.:

$$e<d \tag{3}$$

This ensures that the longest blade cuts all the segments before reaching the tip wearing body.

An optional further requirement is for the tip wear of the longest blade to be less than a maximum allowable value, w, in which case:

$$d>a+g-w \tag{4}$$

Equations (1) to (4) above assume that the "abrasiveness ratio" (i.e. the proportion of incursion which registers as wear on the rotating component relative to the total wear on the rotating component and on the static component) is zero while the blade tip is cutting the abradable layer, and unity once it contacts the tip wearing body part. The equations can, however, be developed further for cases where the abrasiveness ratio is above zero for cutting of the abradable layer, or below unity when contacting the tip wearing body. The equations can also be developed for the case where the closure of the blade tip on to the segments, labeled g above, varies between the individual segments, such as will occur if the casing goes off-centre or out-of-round in the hot running condition.

The above analysis shows how uniform radii of the wear track and the blade tips can be achieved by:

Choosing the material of the blade tips, the abradable layer and the hard body part to achieve required abrasiveness ratios.

Choosing a depth of the abradable layer that is equal to or greater than the expected maximum variation in seal segment radial position.

Choosing a radial cold build clearance, from the shortest blade tip to the tip wearing body, so that even the shortest blade is rubbed by a hard body part.

Improvements in engine efficiency resulting from these uniform radii can be quantified. Compared to a conventional blade tip and seal segment arrangement which does not produce a uniform blade tip radius after running-in, the overall engine efficiency improvement expected in 3-shaft Rolls-Royce Trent engines would be about 0.10 to 0.15% sfc, if the method were applied to each core turbine stage.

In the embodiment described above the most radially inward seal segment acts as a "turning tool" for the blade tips. In another embodiment, the segment that is to act as the turning tool can be carefully positioned at the most inward position. In this way, only that segment needs to have a body part having a sufficient hardness to wear the blade tips.

Figure 4:
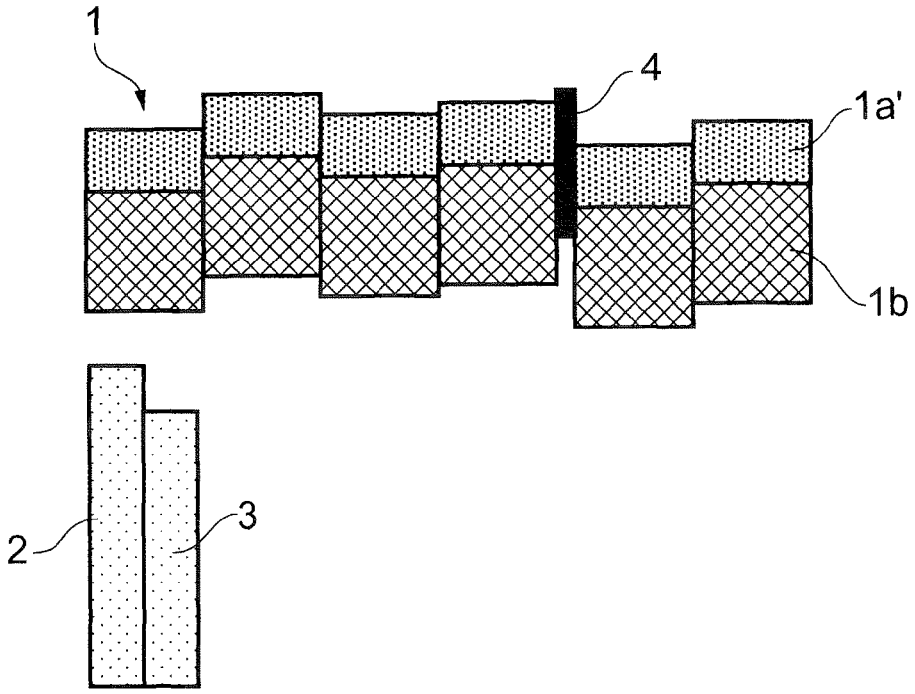
FIG. 4 shows schematically a row of seal segments (again for convenience shown aligned linearly) and two blades with the blades in their cold build (and pre-worn) condition in a further embodiment of the invention.

In a further embodiment, the turning tool could be provided by a body that is not incorporated in the seal. FIG. 4 shows schematically a row of seal segments (again for convenience shown aligned linearly) and two blades with the blades in their cold build (and pre-worn) condition in such an embodiment. Features which are equivalent in this embodiment and the embodiment of FIGS. 1 to 3 have the same reference numbers. A tip wearing body 4 is positioned between two neighbouring seal segments, at a single position around the circumference. The radially inner end of the tip wearing body is at a position equivalent to position d in FIG. 3. In this way all the segments can be made identical, and can have a less hard substrate 1*a*' for the abradable layer 1*b*. The tip wearing body could be a hard tipped component, or be of a uniform hard material, to suit. Further tip wearing bodies could be positioned between other neighbouring seal segments if desired.

While the invention has been described in relation to gas turbine engine, it could also be applied to the formation of seals in other types of rotating machinery.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A system for controlling rotor blade over-tip leakage of a working fluid in a rotating machine, the system comprising:

a circumferential row of rotor blades, a circumferential row of seal segments for sealing with radially outer tips of the rotor blades to reduce over-tip leakage of the working fluid, the seal segments having an inboard abradable layer which is adapted to be abraded by the blade tips to form a wear track for the blade tips, and at least one tip wearing body that is harder than the abradable layer, which is adapted to wear down the blade tips;

wherein a thickness of the abradable layer and cold build radial positions of the blade tips, seal segments and tip wearing bodies are arranged such that, during running-in of the machine under normal operating conditions, and the wear track having a uniform radius is formed in the abradable layer by the blade tips, the at least one tip wearing body also wearing down the blade tips to provide a uniform blade tip radius.

2. The system according to claim 1, wherein the wear track is substantially circumferentially continuous.

3. The system according to claim 1, wherein at least a blade tip contacting portion of the at least one tip wearing body is more wear resistant than the blade tips.

4. The system according to claim 1, wherein the at least one tip wearing body is a portion of a respective seal segment, the abradable layer being formed on the wearing body.

5. The system according to claim 1, wherein a thickness of the abradable layer is equal to or greater than a maximum variation in seal segment radial position.

6. The system according to claim 1, wherein the cold build radial positions are arranged such that a tip of the shortest blade touches a most radially inward or only tip wearing body at a maximum closure of the blade tips towards the seal segments during running-in.

7. The system according to claim 1, wherein the rotating machine is a gas turbine engine.

8. A rotating machine comprising:

the system according to claim 1.

9. A method of controlling rotor blade over-tip leakage of a working fluid in a rotating machine, the method comprising:

providing a circumferential row of rotor blades, a circumferential row of seal segments for sealing with radially outer tips of the rotor blades to reduce over-tip leakage of the working fluid, the seal segments having an inboard abradable layer which is adapted to be abraded by the blade tips to form a wear track for the blade tips, and at least one tip wearing body that is harder than the abradable layer, which is adapted to wear down the blade tips; and running-in the machine such that the wear track having a uniform radius is formed in the abradable layer by the blade tips, and the at least one tip wearing body also wears down the blade tips to provide a uniform blade tip radius under normal operating conditions.

10. The method according to claim 9, wherein the wear track is substantially circumferentially continuous.

11. The method according to claim 9, wherein at least a blade tip contacting portion of the at least one tip wearing body is more wear resistant than the blade tips.

12. The method according to claim 9, wherein the at least one tip wearing body is a portion of a respective seal segment, the abradable layer being formed on the body.

13. The method according to claim 9, wherein the thickness of the abradable layer is equal to or greater than the maximum variation in seal segment radial position.

14. The method according to claim 9, further including a step before the running-in step of arranging the cold build radial positions of the blade tips, seal segments and the at least one tip wearing body such that the tip of the shortest blade touches the most radially inward or only tip wearing body at the maximum closure of the blade tips towards the seal segments during running-in.

15. The method according to claim 9, wherein the rotating machine is a gas turbine engine.

* * * * *